United States Patent [19]

Coes, Jr.

[11] 4,014,142

[45] Mar. 29, 1977

[54] METHOD AND APPARATUS FOR GRINDING AT A CONSTANT METAL REMOVAL RATE

[75] Inventor: Loring Coes, Jr., Princeton, Mass.

[73] Assignee: Norton Company, Worcester, Mass.

[22] Filed: Jan. 16, 1974

[21] Appl. No.: 433,890

[52] U.S. Cl. ..... 51/165.77; 51/165.92; 51/281 R

[51] Int. Cl.[2] ..... B24B 49/00

[58] Field of Search ..... 51/165 R, 165.77, 165.9, 51/165.92, 281 R, 135 R

[56] References Cited

UNITED STATES PATENTS

| | | | |
|---|---|---|---|
| 3,178,861 | 4/1965 | Milias | 51/134.5 R |
| 3,264,788 | 8/1966 | Coes | 51/281 R |
| 3,415,017 | 12/1968 | Murray | 51/135 R |
| 3,524,285 | 8/1970 | Rutt | 51/135 R |
| 3,589,077 | 6/1971 | Lenning | 51/165.92 |

*Primary Examiner*—Harold D. Whitehead
*Attorney, Agent, or Firm*—Rufus M. Franklin

[57] ABSTRACT

A method and apparatus for conditioning steel by grinding at a constant metal removal rate by monitoring net power and the normal force between the wheel and the workpiece, and adjusting the normal force to achieve a given, predetermined metal removal rate is based on the relation between power and normal force at constant wheel speed. A semi-automatic method, by operator control of the normal force, and a fully automatic method are disclosed. Provision for correcting the force in response to wheel wear is optional.

3 Claims, 5 Drawing Figures

FIG. 1
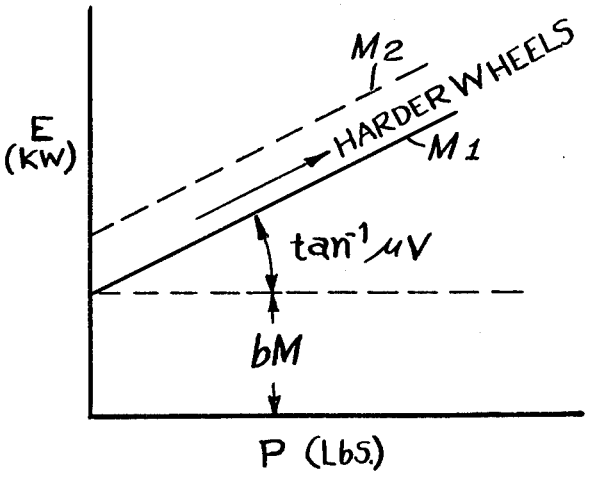
FIG. 2
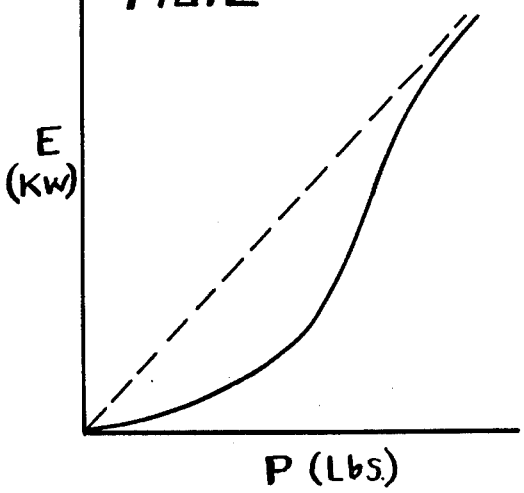
FIG. 3
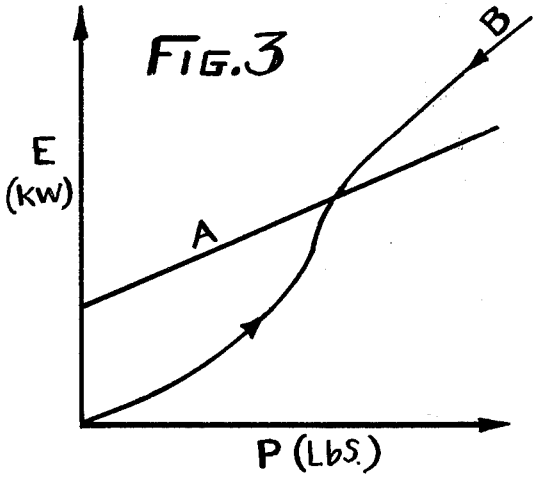
FIG. 5
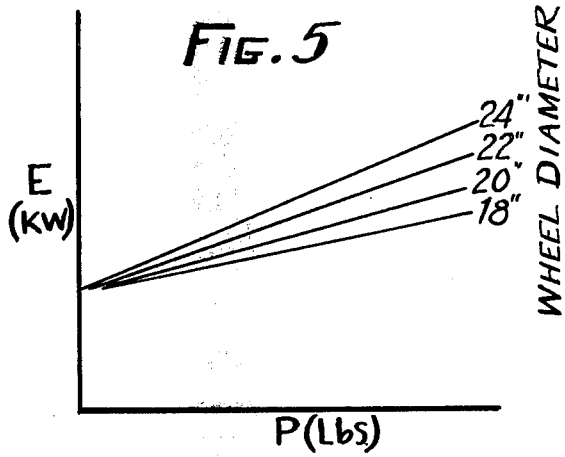
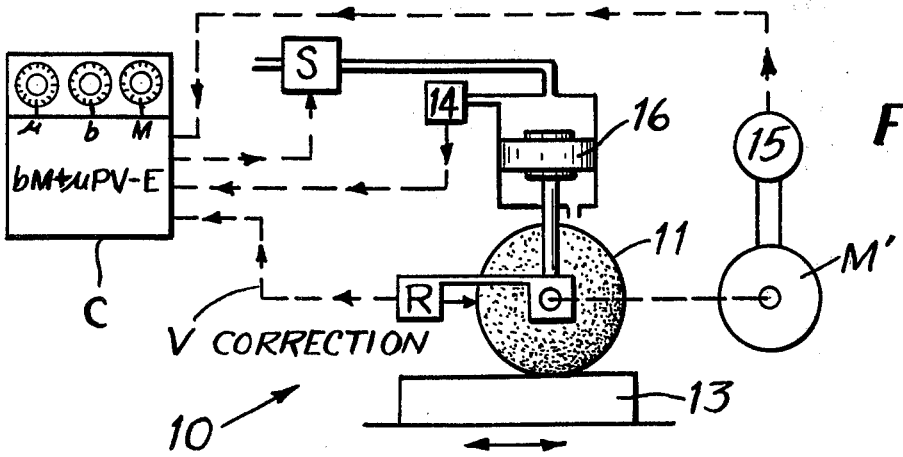
FIG. 4

METHOD AND APPARATUS FOR GRINDING AT A CONSTANT METAL REMOVAL RATE

BACKGROUND OF THE INVENTION

In steel conditioning by grinding it is desirable to grind at a constant metal removal rate to accomplish the job in the shortest time with a minimum loss of metal.

A current practice in the steel conditioning art is to adjust the vertical force on the grinding wheel so as to keep constant the power consumed by the motor driving the wheel, as measured by a power meter. But, faced with a range of wheels which vary in grade, as being supplied by different manufacturers, or containing normal product variation from one source, it is not possible to maintain a constant metal removal rate being guided by the power alone. At the same metal removal rate the softer acting wheels require less power then those of harder grade. This is because, if a softer acting wheel is substituted for a hard one, the vertical (or normal) force on the wheel must be reduced to maintain constant metal removal rate. Consequently if a softer than normal wheel is used at the usual power level the metal loss will be excessive.

DESCRIPTION OF DRAWINGS

In the drawing FIG. 1 is a plot of net power versus vertical force to two different constant metal removal rates, $M_1$ and $M_2$, and at constant wheel speed.

FIG. 2 is a plot of power versus vertical force for a wheel of a spcific grade, $g$.

FIG. 3 is a plot power versus vertical force combining a line for constant metal removal rate with a line for constant wheel grade.

FIG. 4 is a schematic of a control means and grinding machine for practicing the method of the invention.

FIG. 5 is similar to FIG. 1, but wherein the effect of change in wheel diameter at constant R.P.M. is shown.

SUMMARY OF THE INVENTION

A method has been devised by which metal removal rate can be maintained constant regardless of the wheel being used. This is based on the three equations:[1])

1. $M = KPVW/(a+W)$

2. $E = bm + \mu PV$

3. $W = gP$

The quantities in these equations have the following significance and dimensions.

$M$ metal removal rate, lbs./hr.
$P$ vertical or normal force between the wheel and the work, lbs.
$V$ wheel speed, ft./min.
$W$ wheel wear rate, in$^3$/hr.
$E$ net power, kilowatts (actual indicated power minus no-load power)
$K$ constant for metal, 60/ft.
$a$ abrasive wear factor, in$^3$/hr.
$b$ constant for metal, KW/lb./hr.
$\mu$ friction factor, (KW) (Min.)/(ft. lb.)
$g$ Grade factor for wheel, in$^3$/hr./lb.

From Equation 2 it can be seen that at a fixed, chosen, metal removal rate there must be a linear relationship between the power and vertical force as shown in FIG. 1. Since the constants $b$, and $\mu$ are known for most of the common steels this line can be plotted directly. At the selected metal removal rate all wheels must fall on this line with the harder wheels being toward the right.

At a higher selected metal removal rate the performances would be on a parallel line displaced upwards. (dash line)

Substitution of the value of M from Equation 1 in Equation 2 leads to:

$$E = \frac{bKPVW}{a+W} + \mu PV$$

Substituting the value of W from Equation 5 in this leads to:

$$E = \frac{gbKP^2V}{a+gP} + \mu PV \qquad 4.$$

Equation 4 has the shape of the curve shown in FIG. 2 and represents the performance of a single wheel, defined by the value of $g$, as the vertical force is increased. A softer wheel (larger $g$) would follow a similar curve displaced to the left. All grades of wheels asymptotically approach the straight dashed line having the slope: V ($b$K + $\mu$), as the vertical force is indefinitely increased.

Considering FIGS. 1 and 2 a simple method can be used to maintain constant metal removal rate.

This requires a calibrated oscilloscope having the power and vertical force input signals at right angles. On the oscilloscope screen is traced the line from FIG. 1 representing the desired metal removal rate. This requires known values of $b$ and $\mu$.

The operator of the machine has a manual control to vary the vertical force. In his view is the oscilloscope screen on which is marked the fixed curve A. With the machine in operation, as the operator increases the vertical force, the spot on the screen representing the P, E coordinates will trace out the path, B. The operator thus maintains the vertical force at the point where the path, B, crosses the line A and the metal removal rate will remain constant.

It should be noted that it is not necessary to know the values of the constants $g$, $a$, or K, only $b$ and $\mu$.

For 302 stainless steel, th value of $b$ is 0.70 kilowatts/pound/hour, and the value of $\mu$ is $3.70 \times 10^{-6}$ kilowatt minutes/foot pound. Where the values of $b$ and $\mu$ for a given metal are not known they can be calculated from data obtained from constant force grinding tests. The foundation for equations (1), (2) and (3), and the testing methods for determination of the constants are explained in more detail in the book, "Abrasives", by L. Coes, Jr., published by Springer-Verlag, New York, 1971.

It is also possible to automate this system by the following:

DETAILED DESCRIPTION OF INVENTION

Although the above-described semi-automatic operation is within the scope of my invention, it is also possible to automate this system as shown schematically in FIG. 4. Billet grinder 10 includes a grinding wheel 11 driven by motor M', and a piston 16 for applying a vertical force (P) to the grinding wheel 11 which is in contact at its bottom surface with a metal billet 13 which is being conditioned by the wheel.

A pressure sensing means 14 measures the vertical force, P, and wattmeter 15 measures the power, E. The force, P, and the power, E, are converted to electrical signals and fed as input to an analogue computer C. The computer C is designed to compute the difference between the quantity $bM + \mu PV$, and the quantity E. The computer is provided with dials M, $\mu$, and $b$ for setting the desired metal removal rate M, and the constants $\mu$and $b$ for the particular metal being ground. The output of computer C is in the form of an electrical signal (e.g. voltage) which operates servo S. When the output represents a positive difference between the right-hand side of equation 2 and the power, E, it causes the servo S to increase the vertical force P on the wheel by increasing hydraulic pressure on piston 16. When the output represents a negative difference, the force, P, is decreased by the servo. Thus, through the feedback from the force signal and power singal the servomotor S continuously adjusts the force, P, to provide a constant metal removal rate.

Since it is conventional to drive grinding wheels at a constant rpm, and since the diameter of the wheel decreases as it wears, the quantity V, surface speed of the wheel, will gradually decrease in operation with a given wheel. While the above methods assume that the variation in wheel speed is small enough to be insignificant (whereby the normal operating speed of, say, 16,000 feet per minute is pre-set into the computer), it is possible to take such variation into account by employing a device R, which can be mechanical or electrical (as disclosed in U.S. Pat. No. 3,264,788) to monitor the wheel diameter. Such measurement is converted by a transducer to an electrical voltage and used as an input to the computer to decrease the product $\mu PV$ as V decreases. In the semiautomatic version V variation may be compensated by employing a family of curves for wheels of varying diameter. Each such family for a given metal removal rate would intersect the power axis at a common point ($b\ M$), and decrease in slope ($\mu PV$), as V decreases, as shown in FIG. 5.

I claim:

1. A method of grinding at constant metal removal rate comprising determining the difference between the power, E, drawn by the grinding wheel as indicated by a wattmeter, and the power required by a selected metal removal rate M for any wheel calculated as a function of the normal force between the wheel and the work, P, increasing the force, P, on the grinding wheel when the indicated power is less than the calculated power, and decreasing the force, P, on the grinding wheel when the indicated power is more than the calculated power, wherein the instantaneous values of normal force and power are observed on the EP plane in an oscilloscope, and the vertical force is adjusted manually whereby the point representing the instantaneous values of E and P falls on a predetermined straight line representing E as a function of P for a predetermined fixed metal removal rate for wheels of varying grinding grade.

2. In an apparatus for metal conditioning grinding at a fixed, predetermined, metal removal rate comprising a motor driven grinding wheel and a means for varying the normal force between the wheel and the work being ground and including a means for measuring the net power drawn by the wheel in grinding, the improvement comprising a means for converting the net power to a machine readable signal, a means for converting the normal force betwen the wheel and the work to a machine readable signal, means for calculating the power required to give a desired metal removal rate, M, from the relation:

$$E = bM + \mu PV,$$

where $E$, $b$, $M$, $\mu P$, and $V$ have the definitions set forth in the above specification, means for comparing the instantaneous actual net power from the calculated power, and means adapted to increase the normal force between the wheel and the work when the calculated power is greater than the actual net power and to decrease the normal force, when the calculated power is less than than the actual net power.

3. In an apparatus as defined in claim 2, means for measuring the instantaneous diameter of the grinding wheel, and means for adjusting the value of V in the calculation of the product $\mu PV$ whereby the calculated value of E for a given constant metal removal rate is corrected for wheel wear.

* * * * *